US005979842A

United States Patent [19]

Fan

[11] Patent Number: 5,979,842

[45] Date of Patent: Nov. 9, 1999

[54] WIDE OPENING LEAVES BAGGER HAVING A PLATFORM

[76] Inventor: Jianhua Fan, 5800 Maudina Ave Apt. C-2, Nashville, Tenn. 37209

[21] Appl. No.: 09/074,829

[22] Filed: May 8, 1998

[51] Int. Cl.[6] ..... B65B 67/04

[52] U.S. Cl. ..... 248/99; 141/391

[58] Field of Search ..... 248/99, 95, 97; 141/314, 391

[56] References Cited

U.S. PATENT DOCUMENTS 4,273,167 6/1981 Stillwell ..... 141/314

4,312,531 1/1982 Cross ..... 248/99 X 4,485,855 12/1984 Dillingham ..... 248/99 X 5,236,893 8/1993 DeCrane ..... 248/99 X 5,523,519 6/1996 Weber et al. ..... 141/314 X

*Primary Examiner*—Ramon O. Ramirez

*Attorney, Agent, or Firm*—Merchant & Gould P.C.

[57] ABSTRACT

A bagger, with a wide opening formed by a flexible platform to receive leaves and lead the leaves into the bag, has a closed frame with projecting frame members outwardly and upwardly for supporting the flexible platform and a bag holder on top of the frame to hold the bag in an open position to store the leaves received from the flexible platform.

12 Claims, 5 Drawing Sheets

WIDE OPENING LEAVES BAGGER HAVING A PLATFORM

FIELD OF THE INVENTION

The present invention relates to a bagger apparatus, and more particularly to a wide opening bagger apparatus.

BACKGROUND OF THE INVENTION

As it is well known, in autumn, people will sweep and move leaves from areas such as yard or public area. To bag leaves, some may use garbage cans to hold a bag, or even hold a bag by hand. It costs more time and labor to put leaves into the bag, because the opening of the bag is not wide enough. For this reason, some people use blanket, plastic film, even car cover to hold leaves and then move the leaves onto the. truck or somewhere. Although it is easy to receive the leaves in this way, everytime the blanket, plastic film or the car cover cannot hold so many leaves as a trash bag, and the leaves in the blanket and the car cover need to be removed after filling everytime. Packing the leaves is also not an easy thing to do.

Therefore, it can be seen that there is a need for an improved bagger apparatus, particularly a wide opening leaves bagger to receive and move leaves in an easy way.

SUMMERY OF THE INVENTION

In order to overcome the above described considerations, a wide opening bagger apparatus is provided in this invention. The apparatus includes a platform to receive and lead the objects such as leaves into the bag. In addition, a normal trash bag can be used in the bagger apparatus to bag the leaves so that removal of the leaves-filled bag can be an easy thing.

In one embodiment in accordance with the invention, a wide opening bagger apparatus is provided. The bagger apparatus comprises a standing member having a top opening and a plurality of members extending outwardly from the standing member; and a platform having an opening aligned with the top opening of the standing member, the platform being held by the plurality of members.

Still in one embodiment, the platform has a plurality of pieces hanging downwardly from the opening of the platform into the top opening of the standing member.

Further in one embodiment, the platform is flexible.

Accordingly, the invention provides a new and improved bagger apparatus having a wide opening to receive the objects such as leaves.

Another advantage of the present invention is that it provides a simple structure to hold the opening of a bag.

A further advantage of the present invention is that the bagger apparatus can be easily assembled and disassembled.

A further advantage of the present invention is that the flexible platform can be folded for easy storing.

It will be readily appreciated that additional advantages, which will become subsequently apparent, reside in the details of structure and operation of the invention as more fully hereinafter described and claimed.

DETAILED DESCRIPTION OF THE PREFERRED EMBODIMENT

The present invention is a wide opening bagger apparatus.

In the following description of the exemplary embodiment, reference is made to the accompanying drawings which form a part hereof, and in which is shown by way of illustration the specific embodiment in which the invention may be practiced. It is to be understood that other embodiments may be utilized as structural changes may be made without departing from the scope of the present invention.

One of the applications of the present invention is a leaves bagger.

Figure 1:
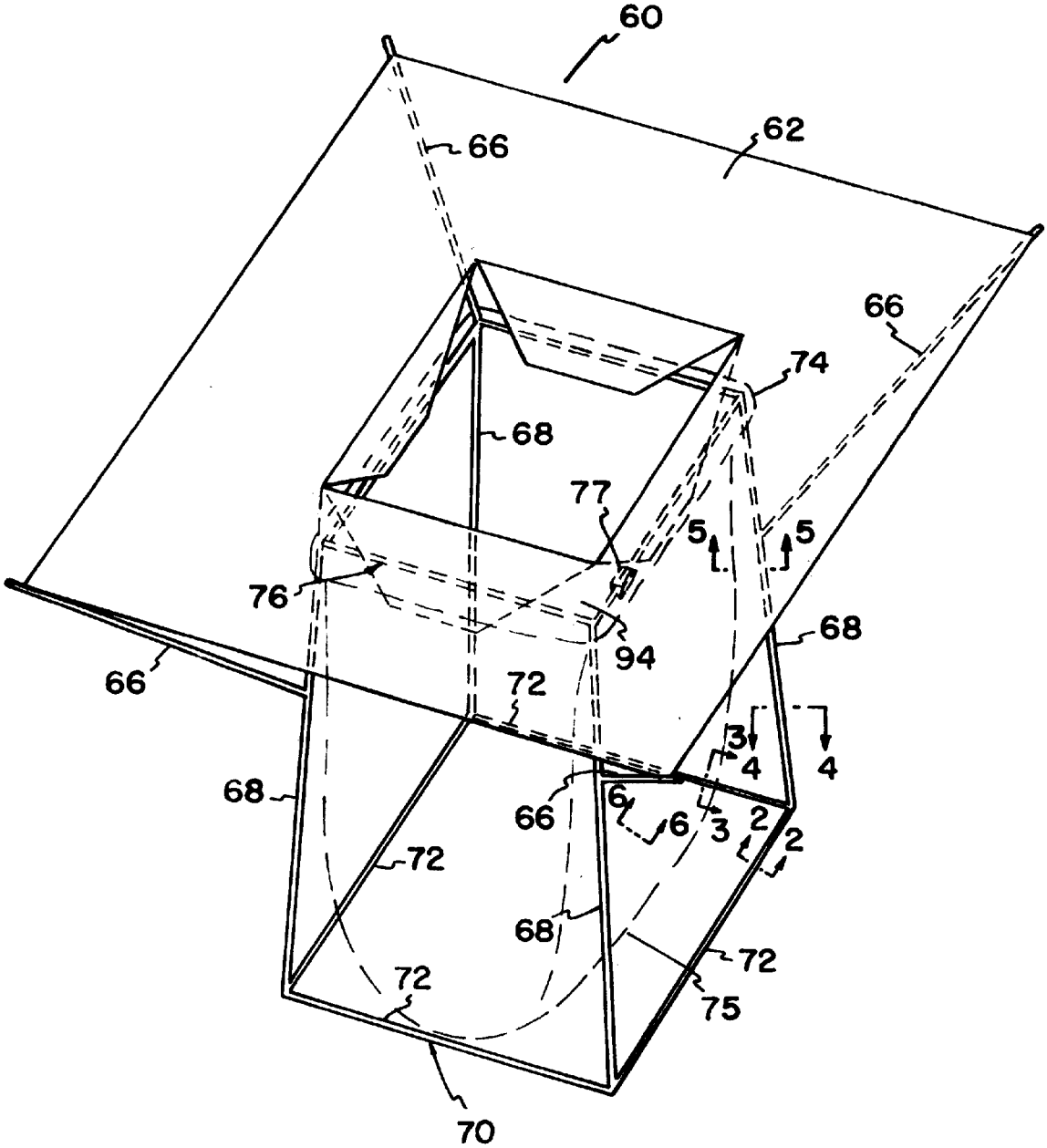
FIG. 1 is a perspective view of a bagger apparatus generally in accordance with the present invention.

One specific implementation of a leaves bagger 60 in accordance with the principles of the present invention is illustrated in FIGS. 1–8. Referring initially to FIG. 1, it is seen that the bagger 60 comprises a flexible platform 62 and a closed four-cornered frame 64 having four projecting frame members 66. Four frame members 72 form a square base 70, four legs 68 each of which has one end attached to the base 70 and the other end connected to a bag holder 76 which is in square. Four projecting frame members 66 extend from each leg 68 upwardly and outwardly, and the flexible platform 62 is then attached to the top of the projecting frame members 66. It is appreciated that the frame can be in any shape such as a circle shape. It is also appreciated that the material used for the frame 64 is not limited. The frame can be made of plastic pipes, metal pipes, or wood stakes, etc.

Figure 2:
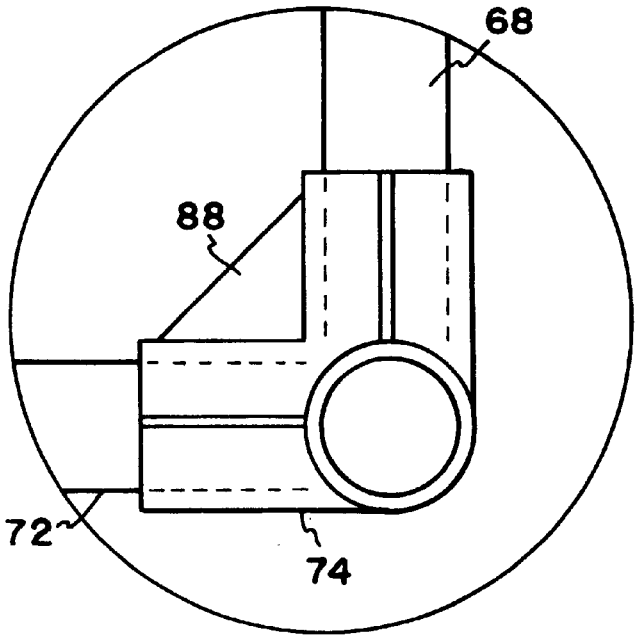
FIG. 2 is an enlarged view of a corner section of the bagger apparatus along line 2—2 of FIG. 1.
Figure 3:
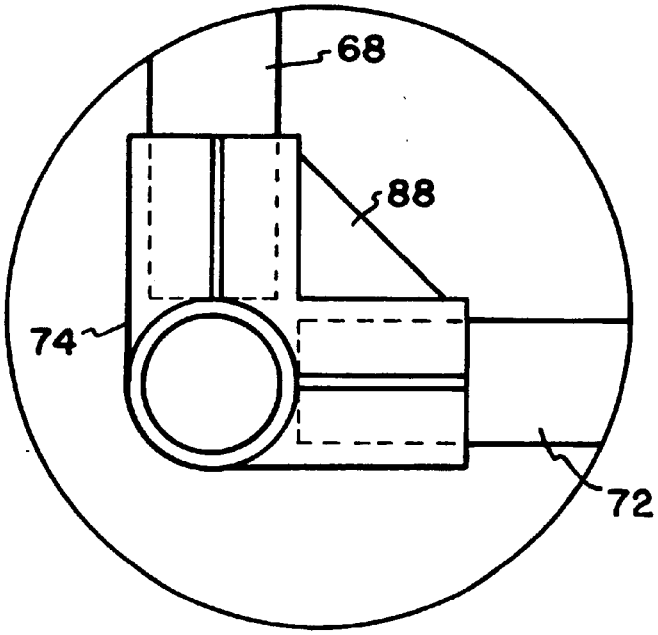
FIG. 3 is an enlarged view of the corner section of the bagger apparatus along line 3—3 of FIG. 1.
Figure 4:
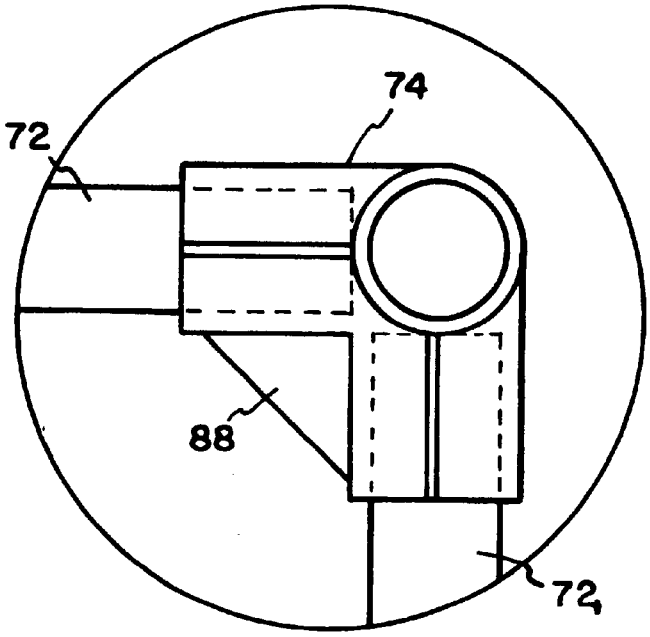
FIG. 4 is an enlarged view of the corner section of the bagger apparatus along line 4—4 of FIG. 1.

FIGS. 2, 3 and 4 show the enlarged views of a corner connector 74 of the frame 64 as shown in FIG. 1. The connector 74 connects the frame members 72 and the leg 68. A piece 88 may be disposed to integrally connect to the connector 74. It is noted that the same connector 74 can be provided to connect the bag holder 76 and the legs 68. In use, after placing the bag into the frame 64, a top edge portion of the bag can be folded over the bag holder 76. A clip can be used to fix the bag to the frame 64 by attaching the top edge portion of the bag to the piece 88.

Figure 5:
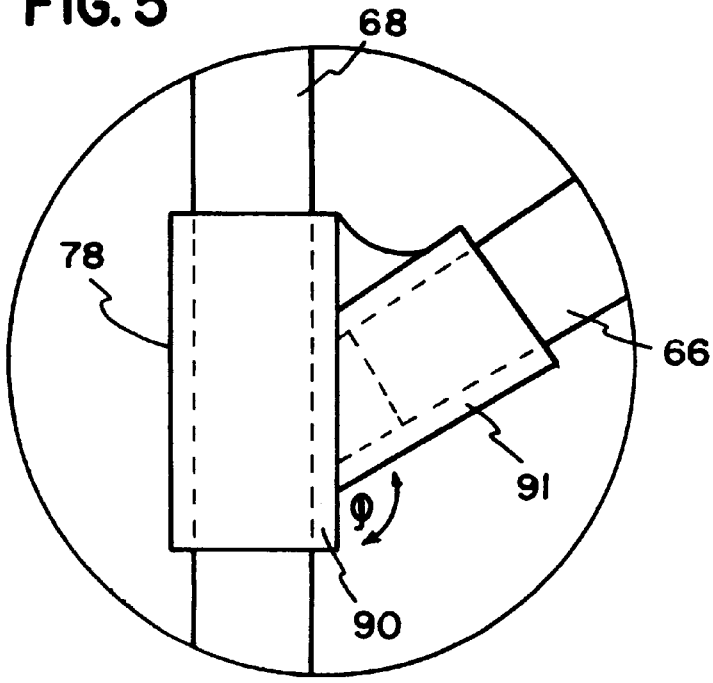
FIG. 5 is an enlarged view of an intersection along line 5—5 of FIG. 1.

FIG. 5 shows a connector 78 between the leg 68 and the projecting frame member 66. The connector 78 includes two integral pieces 90 and 91 with an angle $\phi$ therebetween. The projecting frame member 66 is inserted into the piece 91, and the leg 68 is insert into the piece 90. Preferably, the angle $\phi$ is between 120° and 135°. It is appreciated that other angles can be used within the scope of the invention.

Figure 6:
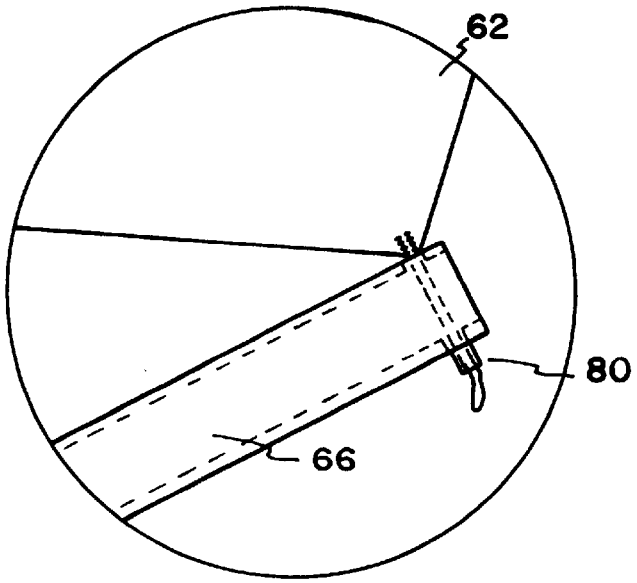
FIG. 6 is an enlarged view of a connection between a projecting member of the frame and a corner of platform along line 6—6 of FIG. 1.

FIG. 6 shows a fastener 80 between the flexible platform 62 and the projecting frame member 66. The fastener 80 fastens the corner of the flexible platform 62 and the top of the projecting frame member 66.

Figure 7:
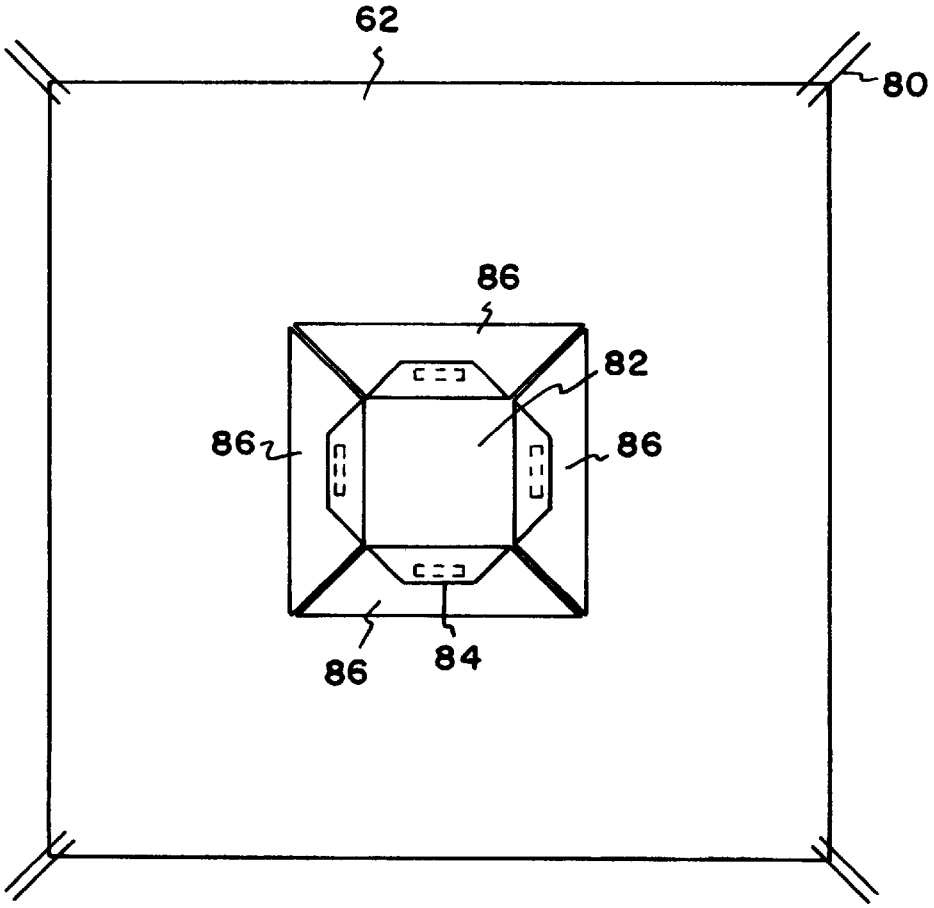
FIG. 7 is a top view of a flexible platform according to the present invention.

FIG. 7 shows a top view of the flexible platform 62. The flexible platform 62 has an opening 82 proximate the center of the platform 62. In one embodiment, the opening 82 can be made by cutting the center of the flexible platform 62 into four triangle shaped pieces 86. It is appreciated that other cutting shapes can be used within the scope of the invention.

Figure 8:
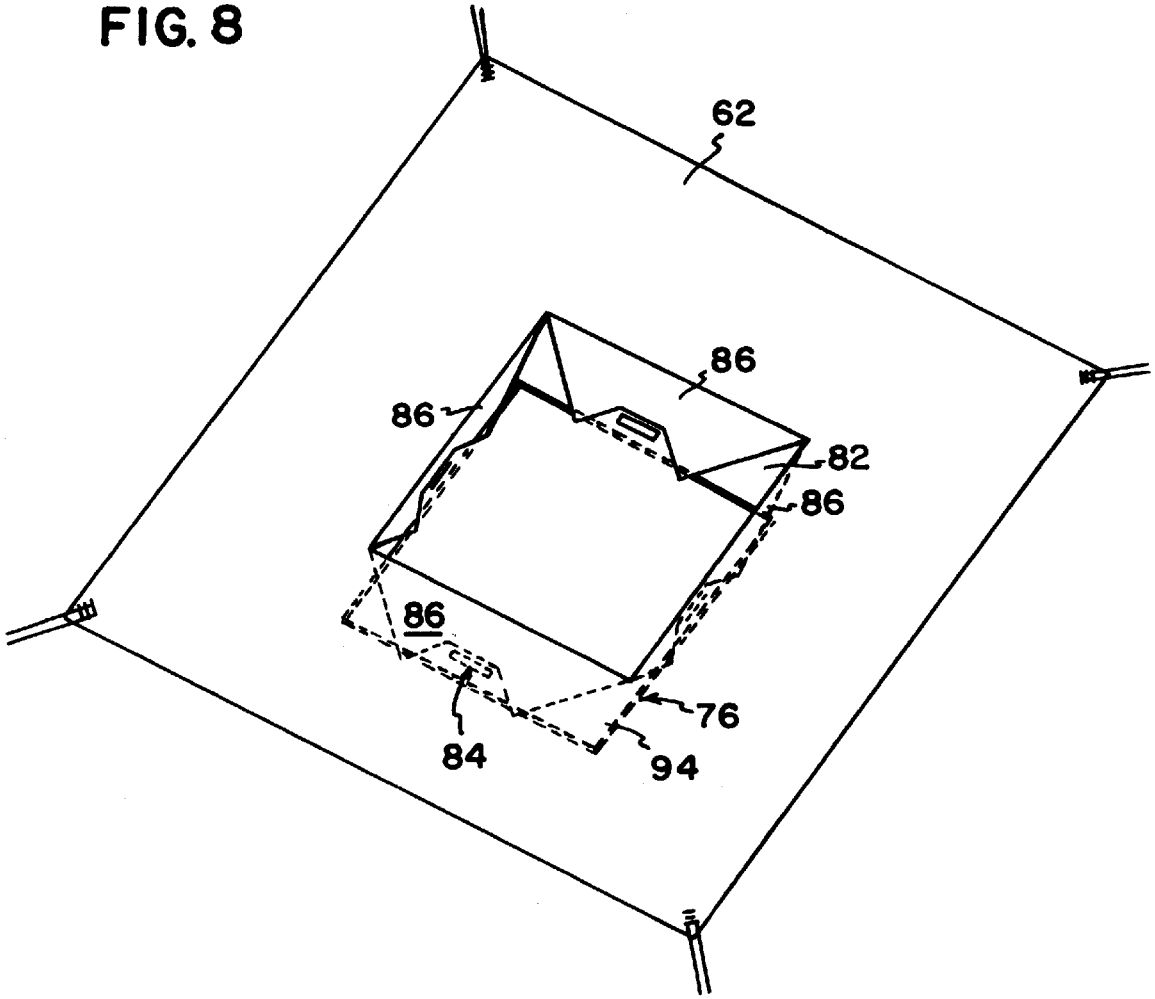
FIG. 8 is a perspective view of a flexible platform attached to a bag holder of the frame.

FIG. 8 shows that the four pieces 86 of the flexible platform 62 hang downwardly toward the bag holder 76 of the frame 64. The opening 82 is aligned with a top opening 94 (see FIG. 1) of the frame 64. In use, the triangle shaped pieces 86 are hung downwardly into the opening of the bag, thus the leaves received by the flexible platform 62 can be led to the bag through the opening 82. The pieces 86 may include fasteners, such as VELCRO 84™, to attach the pieces 86 to the bag holder 76.

The size of the frame 64 can be varied to meet different requirements. The size of the platform 62 can also be varied depending on the frame size and the angle between the leg 68 and the projecting frame member 66. For example, the length and width of the platform 62 can be 36 inches, and the length and width of the opening 82 can be 15 inches; the length and width of the frame 64 can be 18 inches, and the length of the leg 68 can be 24 inches. Because the frame members and the platform can be connected by the connector 74, 78 and the fastener 80, it is easy to assemble and disassemble the frame without any tools.

It is appreciated that many other suitable implementation can be used within the principles of the present invention generally shown above. The foregoing description of the exemplary embodiment of the invention has been presented for the purpose of illustration and description. It is not intended to be exhaustive or to limit the invention to the precise form disclosed. Many modifications and variations are possible in light of the above teaching. It is intended that the scope of the invention be limited not with this detailed description, but rather by the claims appended hereto.

I claim:

1. A bagger apparatus comprising:

a frame having a bag holder on the top;

a flexible platform having an opening proximate a center of the platform aligned with the bag holder and being attached to the frame;

a bag disposed within the frame and having a top edge portion folded outwardly over the bag holder of the frame;

at least one attachment member attaching the top edge portion of the bag to the frame; and wherein the platform has a wider area than the opening and the top edge portion, and is capable of holding an object to be disposed in the bag.

2. A bagger apparatus as claimed in claim 1, wherein the frame is in a closed square shape.

3. A bagger apparatus as claimed in claim 1, wherein the frame further comprises a base, a plurality of legs each of which has one end connected to the base and has the other end connected to the bag holder, and a plurality of projecting frame members extending upwardly and outwardly from the legs.

4. A bagger apparatus as claimed in claim 3, further comprising a plurality of fasteners, wherein the platform is attached to the projecting frame members by the fasteners.

5. A bagger apparatus as claimed in claim 3, wherein the base and the leg are connected by a connector.

6. A bagger apparatus as claimed in claim 3, wherein the leg and the projecting frame member are connected by a connector with an angle.

7. A bagger apparatus as claimed in claim 6, wherein the flexible platform has a plurality of extending pieces disposed downwardly from the center of the platform into the frame.

8. A bagger apparatus for holding a bag, comprising:

a standing member, adapted to support a bag having a top opening;

a plurality of members extending outwardly from the standing member; and a platform having an opening aligned with the top opening of the standing member, the platform being held by the members.

9. A bagger apparatus as claimed in claim 8, wherein the platform has a plurality of pieces hanging downwardly from the opening of the platform into the top opening of the standing member.

10. A bagger apparatus as claimed in claim 9, wherein the platform is flexible.

11. A bagger apparatus as claimed in claim 8, wherein the platform is flexible.

12. A bagger apparatus as claimed in claim 8, wherein the standing member is a frame.

* * * * *

UNITED STATES PATENT AND TRADEMARK OFFICE

CERTIFICATE OF CORRECTION

PATENT NO. : 5,979,842

DATED : NOVEMBER 9, 1999

INVENTOR(S) : FAN

It is certified that error appears in the above-identified patent and that said Letters Patent is hereby corrected as shown below:

Front page, [56] References Cited, U.S. Patent Documents: "5,236,893 8/1993" should read --5,036,893 8/1991--

Col. 1, line 17: "the." should read --the--

Col. 2, line 51: "the bag" should read --a bag 75--

Col. 2, line 52: "the bag" should read --a bag 75--

Col. 2, line 52: "clip" should read --clip 77--

Col. 2, line 57: "ϕ" should read --φ--

Col. 2, line 60: "ϕ" should read --φ--

Col. 4, line 22, claim 7: "claim 6" should read --claim 3--

Col. 4, line 26, claim 8: insert --,-- after "bag"

Signed and Sealed this

Third Day of April, 2001

*Attest:*

*Attesting Officer*

Nicholas P. Godici

NICHOLAS P. GODICI

*Acting Director of the United States Patent and Trademark Office*